US006025040A

United States Patent [19]

Brockley

[11] Patent Number: 6,025,040

[45] Date of Patent: Feb. 15, 2000

[54] GOLF COMMEMORATOR FOR DISPLAYING ACTUAL GOLF BALL AND PICTURE

[75] Inventor: James L. Brockley, Delmar, N.Y.

[73] Assignee: Sportsaver, Albany, N.Y.

[21] Appl. No.: 09/092,337

[22] Filed: Jun. 5, 1998

[51] Int. Cl.[7] ..... A47G 1/12

[52] U.S. Cl. ..... 428/14; 428/542.4; 428/913.3; 40/768; 40/800

[58] Field of Search ..... 428/14, 542.4, 428/913.3; 40/725, 735, 743, 768, 800; 206/315.9; D6/466, 470, 472, 300, 301, 302; D11/132

[56] References Cited

U.S. PATENT DOCUMENTS

| | | | |
|---|---|---|---|
| D. 275,468 | 9/1984 | Grant | D11/157 |
| D. 279,558 | 7/1985 | McJunkin | D11/157 |
| D. 341,277 | 11/1993 | Smith, II | D20/10 |
| D. 391,100 | 2/1998 | Hawkersmith et al. | D6/472 |
| 405,678 | 6/1889 | Rand . | |
| 1,599,779 | 9/1926 | Michlinski et al. . | |
| 3,473,247 | 10/1969 | La Favor et al. | 40/126 |
| 3,548,528 | 12/1970 | Belokin . | |
| 3,715,823 | 2/1973 | Brossard . | |
| 4,984,684 | 1/1991 | Conner et al. | 206/315.3 |
| 5,057,344 | 10/1991 | Mealey | 428/912.2 |
| 5,174,054 | 12/1992 | Politi | 40/152 |
| 5,184,735 | 2/1993 | Black | 211/14 |
| 5,199,200 | 4/1993 | Howell | 40/152 |
| 5,365,683 | 11/1994 | Borja | 40/152.1 |
| 5,377,828 | 1/1995 | Jaroshewich | 206/315.1 |
| 5,392,544 | 2/1995 | Price | 40/152 |
| 5,428,911 | 7/1995 | Figone et al. | 40/209 |
| 5,584,135 | 12/1996 | Hosker | 40/800 |

*Primary Examiner*—Mark L. Bell
*Assistant Examiner*—David R. Sample
*Attorney, Agent, or Firm*—Heslin & Rothenberg, P.C.

[57] ABSTRACT

A golf commemorator includes a support with a forward portion having an open interior for displaying a picture (e.g., a photograph) on a layer and an actual golf ball superimposed with a cover. A first transparent portion of the cover serves to buttress the layer. A second transparent portion of the cover serves to receive the golf ball. Forward and rearward interfaces serve to secure the cover and the layer for displaying the picture and the golf ball in the open interior. In one example, the support can include a frame and/or a backing, and the forward and/or rearward interfaces can comprise a stop and/or a fastener. The forward and/or rearward interfaces can be formed integrally with the support. The cover can comprise a transparent member having an expanse with a hollow protuberance. A section of the expanse can be formed substantially flat, for buttressing the layer. The hollow protuberance preferably has sufficient space to substantially cup the golf ball. The picture can be superimposed and/or associated visually with the golf ball.

20 Claims, 2 Drawing Sheets

GOLF COMMEMORATOR FOR DISPLAYING ACTUAL GOLF BALL AND PICTURE

TECHNICAL FIELD

This invention relates, generally, to golf memorabilia and, more particularly, to a golf commemorator which displays a golf ball.

BACKGROUND ART

When an event is held, those involved or interested usually appreciate it if memorabilia is available. For example, such an event may have a social, political, or business character. Also, persons interested in the memorabilia may include, for instance, sponsors, patrons, participants, attendees, fans, agents, representatives or collectors. Furthermore, some enterprises are geared toward providing such memorabilia, and they wish to provide products which are attractive and desirable.

A way to make memorabilia attractive and desirable is to closely connect the memorabilia with one or more special aspects of the event. For example, memorabilia may be made to include physical objects or pictures for highlighting or celebrating one or more particular occasions, locations, activities, sponsors or participants.

One known configuration for a sportsman's display and gift article mounts a light weight, imitation golf ball atop a golf tee. The golf tee and imitation golf ball are supported without touching a surface, by a mounting which is capable of supporting extremely light weight. The surface has space located alongside the imitation golf ball and the golf tee, for inscriptive material or a calendar. Such a design is disclosed in U.S. Pat. No. 3,473,247 to La Favor et al. (entitled "Display Device for Sportsmen" and issued Oct. 21, 1969). A shortcoming of this design is the limitation of the mounting to supporting extremely light weight. Another shortcoming is the lack of cover for the displayed object and material. A further shortcoming is the separation between the displayed object and material.

Thus, a need exists for a golf commemorator which is capable of displaying an actual golf ball along with a picture. Another need exists for such a golf commemorator which closely associates the actual golf ball with the picture. A further need exists for the golf commemorator to cover the actual golf ball and the picture.

SUMMARY OF THE INVENTION

Pursuant to the present invention, shortcomings of the existing art are overcome and additional advantages are provided through the provision of a golf commemorator for displaying an actual golf ball and a picture.

In one aspect of the invention, a golf commemorator includes a cover, a support, and forward and rearward interfaces. The support is formed with forward and rearward portions. The forward portion of the support has an open interior for displaying a picture on a layer and an actual golf ball superimposed with the cover. The cover is formed with first and second transparent portions. The first transparent portion of the cover serves to buttress the layer. The second transparent portion of the cover serves to receive the golf ball. The forward interface is provided between the forward portion of the support and a peripheral portion of the cover. The rearward interface is provided between the layer and the rearward portion of the support. The forward and rearward interfaces serve to secure the cover and the layer for displaying the picture and the golf ball in the open interior.

In another aspect of the invention, the cover can comprise a transparent member. The first transparent portion of the cover can be formed substantially flat. The second transparent portion of the cover can be formed with a chamber having sufficient space to substantially cup the golf ball.

The support can include a frame and/or a backing. The forward and/or rearward interfaces can comprises a stop and/or a fastener. The forward and/or rearward interfaces can be formed integrally with the support.

In a combination with the actual golf ball, the second transparent portion of the cover can substantially cup the golf ball. In a combination with the actual golf ball and the layer with the picture, the picture can be superimposed with the golf ball. In a combination with the actual golf ball and the layer with the picture, the picture can be associated visually with the golf ball. In a combination with the layer with the picture, the picture can comprise a photograph.

In yet another aspect of the present invention, a golf commemorator includes a transparent member, a support, and forward and rearward interfaces. The support is formed with forward and rearward portions. The forward portion of the support has an open interior for displaying a picture on a layer and an actual golf ball superimposed with the transparent member. The transparent member is formed with an expanse including a hollow protuberance. A section of the expanse serves to buttress the layer. The hollow protuberance serves to receive the golf ball. The forward interface is provided between the forward portion of the support and a peripheral portion of the transparent member. The rearward interface is provided between the layer and the rearward portion of the support. The forward and rearward interfaces serve to secure the transparent member and the layer for displaying the picture and the golf ball in the open interior.

In a further aspect of the invention, the section of the expanse of the transparent member can be formed substantially flat. The hollow protuberance can have sufficient space to substantially cup the golf ball.

The invention further contemplates a method for displaying an actual golf ball and a picture on a layer. A support having an open interior is selected. A cover having a transparent expanse with a transparent chamber is selected. The transparent chamber is superimposed over the actual golf ball in the open interior. The transparent expanse is superimposed over the picture on the layer in the open interior. The actual golf ball and the layer are secured in the open interior, whereby the actual golf ball and the picture are displayed.

Thus, the present invention advantageously provides a golf commemorator which can display an actual golf ball along with a picture. Furthermore, the golf commemorator can closely associate the actual golf ball with the picture. In addition, the golf commemorator can cover the actual golf ball and the picture.

BRIEF DESCRIPTION OF THE DRAWINGS

The subject matter which is regarded as the invention is particularly pointed out and distinctly claimed in the claims at the conclusion of the specification. The foregoing and other objects, features, and advantages of the invention will be readily understood from the following detailed description of preferred embodiments taken in conjunction with the accompanying drawings in which:

BEST MODE FOR CARRYING OUT THE INVENTION

In accordance with the principles of the present invention, a golf commemorator is provided in which a cover includes flat and curved transparent surfaces for displaying an actual golf ball and a picture.

Figure 1:
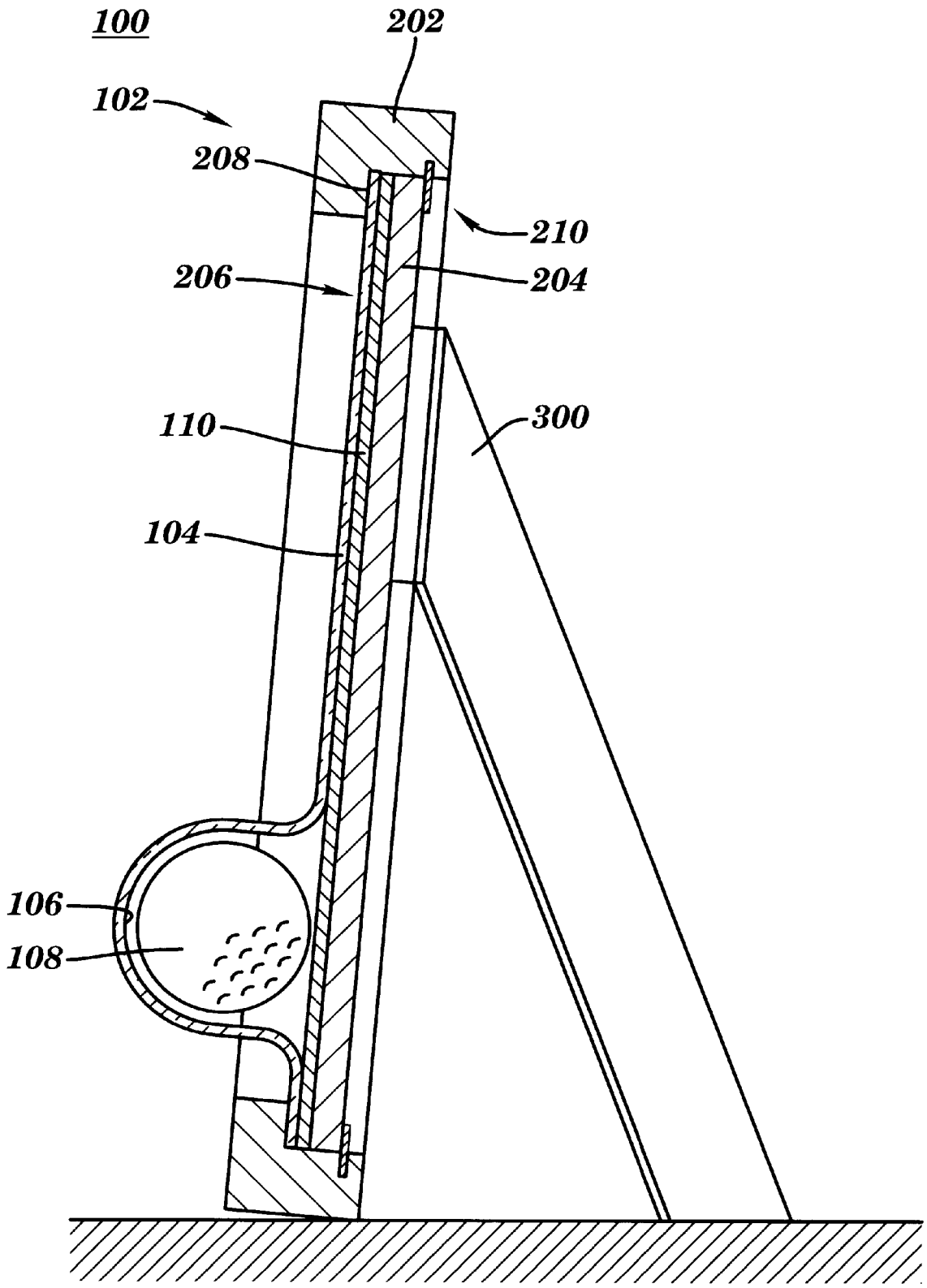
FIG. 1 is a sectional, side view of one example of an actual golf ball held over a picture in a golf commemorator incorporating and using the capabilities of the present invention, illustrating a prop in an open position.

An example of a golf commemorator incorporating and using the novel features of the present invention is depicted in FIG. 1 and described in detail herein.

Figure 2:
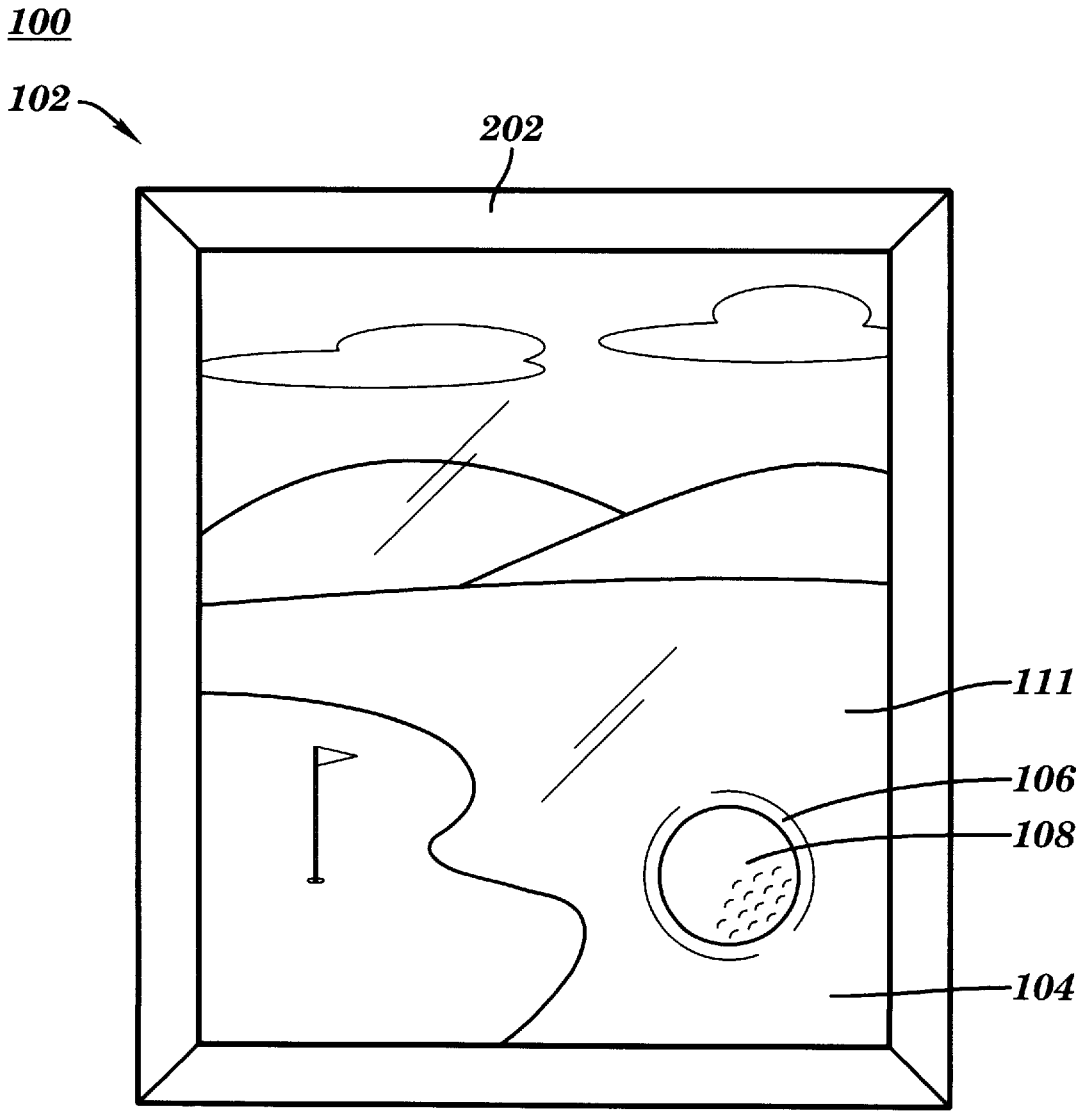
FIG. 2 is a reduced, plan view of the golf commemorator of FIG. 1, illustrating the picture as having a portrait orientation.

In this exemplary embodiment, golf commemorator 100 includes support 102 which receives cover 104. The support is further described herein. In one example, the cover includes chamber 106 which receives actual golf ball 108. That is, the golf ball has been or could be used in an actual round of golf, for instance, played in accordance with the standards of the Professional Golfers' Association ("PGA") and/or the United States Golf Association ("USGA"). Referring to FIGS. 1–2, the golf ball is preferably superimposed over layer 110 having picture 111 thereon, where the golf ball and picture are located between or held by the cover and support. Preferably, the chamber serves to cup the golf ball. In one embodiment, the chamber is shaped and/or sized to just fit over the golf ball, and the remainder of the cover is formed flat, to give an impression, recollection, or feel to the viewer thereof of having access to the golf ball with the view and/or golf ball present or closely connected with a scene shown in the picture. In a further example, the chamber might be shaped and/or sized to provide room or space sufficient to just allow the golf ball to minimally contact the layer, while the remainder of the golf ball is disposed in the chamber forward of and outwardly from the picture, toward a viewer of the golf commemorator.

Referring to FIG. 1, golf ball 108 may comprise a golf ball which satisfies the standards of, for instance, the Professional Golfers' Association and/or the United States Golf Association. In one aspect, the golf ball may comprise a commercially available or customized golf ball. In another aspect, the golf ball, picture 111, layer 110, cover 104 or support 102 may include inscription, marking, or writing thereon, thereabout, or therein.

Referring to FIGS. 1–2, cover 104 provides transparency for displaying golf ball 108 and picture 111. In one example, the cover may be clear. In another example, the cover may be transparent yet capable of providing, for example, optical modification(s). The cover may include, for instance, tinting such as for highlighting, introducing, and/or filtering color (s). In one embodiment, the cover might be formed with material(s) such as plastic and/or glass, and/or various natural and/or synthetic material(s). For instance, the cover may be molded from plastic to include a hollow protuberance serving as chamber 106. In one example, the cover has sufficient strength and/or durability to withstand clamping at its periphery by support 102, buttress layer 110, and continuously hold in the chamber weight of the actual golf ball .

For purposes of illustration, FIG. 2 depicts golf commemorator 100 as displaying picture 111 on layer 110 in a "portrait" orientation, where the picture itself is depicted as having a portrait orientation. In one example, a portrait mode orients graphics and/or character(s) along the longer of the two major axes of the picture and/or the golf commemorator. In another example, the picture on the layer may have a "landscape" orientation. For instance, a landscape mode may orient graphics and/or character(s) along the shorter of the two major axes of the picture and/or the golf commemorator.

As can be understood through examination of FIGS. 1–2, stand 300 may, in one example, enable and/or assist presentation of picture 111 in a portrait mode. In another example, the stand may be configured for presentation of the picture in a landscape mode. The stand is further described herein.

Figure 3:
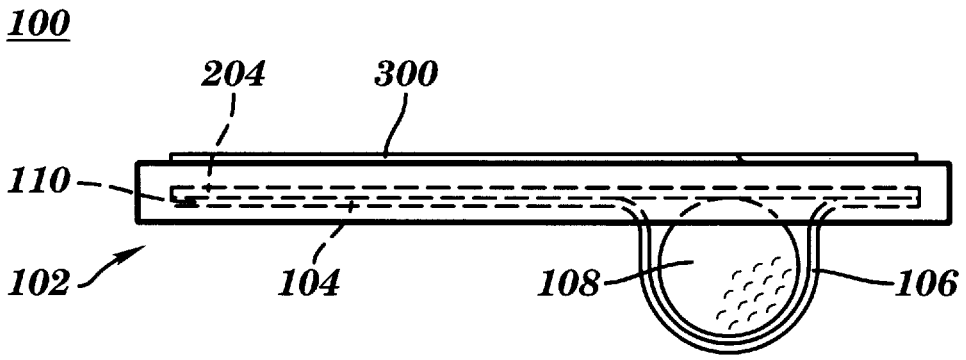
FIG. 3 is an end representation of the golf commemorator of FIG. 2, illustrating the prop in a closed position.

Referring to FIG. 2, picture 111 may comprise, for example, a photograph, illustration, print, drawing, inking, painting, design or rendition. Preferably, the picture is directed to a golf course or golf outing, and is further described herein. Referring to FIGS. 1 and 3, in one example, layer 110 may comprise paper, photosensitive surface, canvas, fabric, screen, silk, mesh or plate.

Again referring to FIG. 1, support 102 may include frame 202 and backing 204. For example, the frame might be formed with material(s) such as (e.g., stained, finished, and/or decorated) wood, plastic, and/or metal. In one example, a plurality of pieces may be connected together in order to form the frame.

For explanatory purposes, frame 202 and picture 111 on layer 110 are illustrated as rectangular. In accordance with principles of the present invention, these and other component(s) of golf commemorator 100, or item(s) used therewith, may have any appropriate shape(s). For instance, one or more of the frame and the picture on the layer may be elliptical.

In one aspect, referring to FIG. 1, frame 202 may form a solid periphery about an open interior such as (e.g., central) opening 206. The frame may be, in one example, configured so the size of the opening provides room or space to display picture 111 and golf ball 108, superimposed with cover 104. Furthermore, the frame may include, for instance, stop(s) 208 which may serve or cooperate in providing direct and/or indirect (e.g., mechanical) support for item(s) such as cover 104, the golf ball, layer 110, and/or the backing. In one embodiment, the stop(s) may be formed (e.g., integrally) with, machined in, or carved into the frame.

In one example, still referring to FIG. 1, cover 104 may be inserted into opening 206 from the rear, so a rim or periphery of the cover abuts stop(s) 208. Also, golf ball 108 may be inserted into chamber 106 of the cover. Layer 110 having picture 111 thereon may be positioned in back of the golf ball 108, and backing 204 may be positioned behind the layer. The stop(s) may serve to prevent, restrict, or limit forward movement of the cover by abutment therewith, thereby consequently also limiting forward movement of the golf ball, the layer, and the backing which may all be positioned behind the cover.

Furthermore, referring to FIG. 1, there may be provided direct and/or indirect (e.g., mechanical) support from the rear for item(s) such as cover 104, golf ball 108, layer 110, and/or backing 204. In one example, fastener(s) 210 may comprise a number of peripheral recesses or a continuous groove in frame 202, and (e.g., metal or hard plastic) tab(s) received therein. For instance, the tab(s) may be pivotally (e.g., with one or more pins) mounted at the rear of the backing, such as are commonly available for use with frames (e.g., for 8 in. by 10 in. photographs). In an alternative embodiment, the tab(s) might be (e.g., pivotally) connected to the frame. In embodiment, wedge(s) and/or shim(s) may be employed with or substitute for the tab(s). In one aspect, the fastener may provide or cooperate in providing direct and/or indirect rearward physical support to item(s) such as the cover, the golf ball, the layer and/or the backing.

For instance, following placement of cover 104 into opening 206, In abutment with stop(s) 208, and positioning into the opening of golf ball 108, layer 110, and backing 204 behind the cover, the tab(s) may be pivoted to secure the cover, the golf ball, the layer and the backing between fastener(s) 210 and stop(s) 208. That is, the fastener(s) and the stop(s) may maintain a clamping pressure among the cover, the golf ball, the layer and the backing so the same are secured in the opening for display of the golf ball and picture 111.

In one aspect, referring to FIG. 1, stop(s) 208 may serve as a forward interface between frame 202 and cover 104 by directly physically supporting the cover against forward movement past the stop(s), where the cover superimposes golf ball 108 and layer 110. Further, fastener(s) 210 and backing 204 may serve as a rearward interface between the layer and the frame by directly supporting the layer against rearward movement past the backing secured with fastener (s), where the layer is superimposed with the cover and the golf ball.

In one alternative embodiment, cover 104 might be formed (e.g., integrally) with frame 202. In another alternative embodiment, stop(s) 208 might be formed separately from the frame, and be mounted, fastened, or attached therein. In yet another alternative embodiment, layer 110 might be formed integrally with backing 204.

Again referring to FIG. 1, in one alternative embodiment, fastener(s) (not shown) such as fastener(s) 210 may be formed, provided, or positioned at, or substitute for, stop(s) 208, such as for providing or assisting in support of cover 104, golf ball 108, layer 110 and/or backing 204, for a forward interface. In another alternative embodiment, stop (s) (not shown) which face forward, rather than stop(s) 208 which are depicted for explanatory purposes as facing rearward, may be formed, provided, or positioned at, or substitute for, the fastener(s) 210, for providing or assisting in support of the cover, the golf ball, the layer and/or the backing, for a rearward interface. For instance, golf commemorator 100 may be configured so the backing is positioned against a stop, the layer positioned thereover, and the cover superimposing the golf ball positioned thereon, where a fastener serves to secure the cover to the frame. In yet another alternative embodiment, the backing might be formed (e.g., integrally) with the frame.

Referring to FIG. 1, prop (e.g., collapsible, swingable, or enfoldable stand, arm, or brace) 300 may be connected (e.g., hinged) to backing 204, such as for enabling desired presentation or viewing of golf commemorator 100 (e.g., with a portrait or landscape orientation) on a horizontal surface, such as may be provided with a shelf, cabinet, mantel, case or desk. FIG. 1 depicts the prop in an open position, while FIG. 3 depicts the prop in a closed position. In another example, the backing and/or frame 202 might include a hinge, wire, and/or loop (not shown), such as for hanging of the golf commemorator (e.g., with a portrait or landscape orientation) on a vertical surface, such as a wall or door. Optionally, a given golf commemorator 100 might omit or allow removal of the prop 300, such as where the golf commemorator will be hung on a wall. For instance, the backing and/or prop might be of, or resemble, usual type(s) thereof used, or usable, with a frame for a photograph.

For illustrative purposes, FIG. 2 depicts picture 111 on layer 110 (FIGS. 1 and 3) as a partial perspective view (e.g., a photograph) of a green on a golf course. In one aspect, referring to FIG. 2, golf commemorator 100 may serve to associate actual golf ball 108 and picture 111, such as in suggesting flight, location, or address of the golf ball relative to a golf fairway, golf lie, golf green, golf tee box, golf club, country club or person(s). In another aspect, the golf commemorator may serve as a remembrance of a corporate or charity tournament, or a special golf getaway. Furthermore, the golf commemorator might be used as a customer appreciation gift. Moreover, the golf commemorator may be used by collectors. In one example, the golf ball placed in the golf commemorator may be the very golf ball used by a special person, such as the person who receives, gives, purchases or donates the golf commemorator, or a famous or notable person. In another example, the golf ball and/or picture may include special marking(s) or signature(s) thereon, and/or the picture may include special scene(s), object(s), or person (s), such as to commemorate occasion(s) (e.g., a hole-in-one or a noteworthy round of golf or event), celebrate person(s) (e.g., a professional or amateur athlete, a politician, entertainer, or business leader, or a friend or companion), or recall location(s) (e.g., a famous golf course or favorite, desired, or fantastic vacation destination).

While part(s) of the description herein, for explanatory purposes, may imply or indicate certain exemplary direction (s), such direction(s) may be considered relative. Design choice(s) allow accommodation(s) of any orientation(s) for any golf commemorator(s) in accordance with the principles of the present invention.

Although preferred embodiments have been depicted and described in detail herein, it will be apparent to those skilled in the relevant art that various modifications, additions, substitutions and the like can be made without departing from the spirit of the invention and these are therefore considered to be within the scope of the invention as defined in the following claims.

What is claimed is:

1. A golf commemorator, comprising:

a cover;

a support formed with forward and rearward portions;

said forward portion having an open interior for displaying a picture on a layer and an actual golf ball superimposed with said cover;

said cover formed with first and second transparent portions, said first transparent portion serving to buttress said layer, said second transparent portion serving to receive said golf ball;

a forward interface between said forward portion and a peripheral portion of said cover; and a rearward interface between said layer and said rearward portion, wherein said forward and rearward interfaces serve to secure said cover and said layer for displaying said picture and said golf ball in said open interior.

2. The commemorator of claim 1, wherein said cover comprises a transparent member.

3. The commemorator of claim 1, wherein said first transparent portion is formed substantially flat, and wherein said second transparent portion is formed with a chamber having sufficient space to substantially cup said golf ball.

4. The commemorator of claim 1, wherein said support includes at least one of a frame and a backing.

5. The commemorator of claim 1, wherein at least one of said forward and rearward interfaces comprises at least one of a stop and a fastener.

6. The commemorator of claim 1, wherein at least one of said forward and rearward interfaces is formed integrally with said support.

7. The commemorator of claim 1 in combination with said actual golf ball, wherein said second transparent portion substantially cups said golf ball.

8. The commemorator of claim 1 in combination with said actual golf ball and said layer with said picture, wherein said picture is superimposed with said golf ball.

9. The commemorator of claim 1 in combination with said actual golf ball and said layer with said picture, wherein said picture is associated visually with said golf ball.

10. The commemorator of claim 1 in combination with said layer with said picture, wherein said picture comprises a photograph.

11. A golf commemorator, comprising:

a transparent member;

a support formed with forward and rearward portions;

said forward portion having an open interior for displaying a picture on a layer and an actual golf ball superimposed with said transparent member;

said transparent member formed with an expanse including a hollow protuberance, a section of said expanse serving to buttress said layer, said hollow protuberance serving to receive said golf ball;

a forward interface between said forward portion and a peripheral portion of said transparent member; and a rearward interface between said layer and said rearward portion, wherein said forward and rearward interfaces serve to secure said transparent member and said layer for displaying said picture and said golf ball in said open interior.

12. The commemorator of claim 11, wherein said section of said expanse is formed substantially flat, and wherein said hollow protuberance has sufficient space to substantially cup said golf ball.

13. The commemorator of claim 11, wherein said support includes at least one of a frame and a backing.

14. The commemorator of claim 11, wherein at least one of said forward and rearward interfaces comprises at least one of a stop and a fastener.

15. The commemorator of claim 11, wherein at least one of said forward and rearward interfaces is formed integrally with said support.

16. The commemorator of claim 11 in combination with said actual golf ball, wherein said hollow protuberance substantially cups said golf ball.

17. The commemorator of claim 11 in combination with said actual golf ball and said layer with said picture, wherein said picture is superimposed with said golf ball.

18. The commemorator of claim 11 in combination with said actual golf ball and said layer with said picture, wherein said picture is associated visually with said golf ball.

19. The commemorator of claim 11 in combination with said layer with said picture, wherein said picture comprises a photograph.

20. A method of displaying an actual golf ball and a picture on a layer, said method comprising:

selecting a support having an open interior;

selecting a cover having a transparent expanse with a transparent chamber;

superimposing said transparent chamber over said actual golf ball in said open interior;

superimposing said transparent expanse over said picture on said layer in said open interior; and securing said actual golf ball and said layer in said open interior, whereby said actual golf ball and said picture are displayed.

* * * * *